US006606806B2

(12) United States Patent
Butters et al.

(10) Patent No.: US 6,606,806 B2
(45) Date of Patent: Aug. 19, 2003

(54) FOLDABLE IRONING BOARD

(75) Inventors: Jonathan Butters, Liverpool (GB); Neil Lonergan, Cheshire (GB); Brian Day, Cheshire (GB)

(73) Assignee: Innovation Design Technology Limited, Liverpool (GB)

( * ) Notice: Subject to any disclaimer, the term of this patent is extended or adjusted under 35 U.S.C. 154(b) by 0 days.

(21) Appl. No.: 10/092,391

(22) Filed: Mar. 6, 2002

(65) Prior Publication Data

US 2002/0152649 A1 Oct. 24, 2002

(30) Foreign Application Priority Data

Mar. 6, 2001 (GB) ..... 0105546

(51) Int. Cl.[7] ..... D06F 81/06

(52) U.S. Cl. ..... 38/137; 312/245

(58) Field of Search ..... 38/137, 107, 104, 38/138, 139; 108/42, 47, 48; 312/21, 26, 242, 245

(56) References Cited

U.S. PATENT DOCUMENTS

| | | | | | |
|---|---|---|---|---|---|
| 1,632,939 | A | * | 6/1927 | Williams | 108/37 |
| 1,858,765 | A | * | 5/1932 | Cramer | 312/22 |
| 2,475,106 | A | * | 7/1949 | Mohr et al. | 38/137 |
| 4,995,681 | A | * | 2/1991 | Parnell | 312/242 |
| 5,369,898 | A | * | 12/1994 | Sorensen | 38/137 |
| 5,669,314 | A | * | 9/1997 | Grant | 108/48 |

FOREIGN PATENT DOCUMENTS

GB 2328449 2/1999

* cited by examiner

*Primary Examiner*—Ismael Izaguirre
(74) *Attorney, Agent, or Firm*—Collard & Roe, P.C.

(57) ABSTRACT

A foldable ironing board installation comprises an ironing board member, hinged to a lower panel member and connected thereto by a gas spring strut. The ironing board member can occupy a generally horizontal working position and an upright stowed position where it is coplanar with the lower panel member. An iron retention housing is arranged behind the lower panel member and stowed position of the ironing board member, and includes a surface which is inclined away from the member and to provide a rest for an iron so that the latter will rest against a wall of the housing.

1 Claim, 2 Drawing Sheets

FOLDABLE IRONING BOARD

BACKGROUND

This invention relates to improvements in ironing boards. A flexible ironing board is disclosed in GB-A2,328,449 (Day) which comprises a board member with an upper ironing surface and a lower surface, which is provided with, silvered glass to form a mirror when the board is stood vertically with the upper ironing surface facing the wall. The board is supported by articulated arms, which fold parallel with the board when stowed. The board is pivoted on pins, which are slidably mounted in recesses forming tracks in a support frame, and also there is a recess to receive an iron within the board. A timed switch may be used which is automatically operated by deployment of the board, and cuts off power to the iron after a predetermined period and a further cut off switch may remove power from the iron when the iron and board are stowed.

One problem with this construction is that the sliding pivot of the board presents a safety hazard, has a tendency to noise creation, and also may jam. A further problem is storage of the iron in a recess on the upper surface of the board. The handle must of necessity protrude above the board and as the board is stowed vertically within the supporting frame, there is a risk if the iron is not properly seated in the recess, or there is damage to the recess, of the iron falling out of the recess when the board is stowed.

It is accordingly an object of the invention to provide an ironing board construction which will provide a secure housing for the iron and further provides for smoother and safer, more controlled opening and retraction of the ironing board between its upright stowed and horizontal extended positions.

SUMMARY

According to the invention a foldable ironing board installation comprises an ironing board member which is connected by a hinge to a lower panel member. The ironing board member can be pivoted between an upright stowed position wherein it provides a continuous surface with the lower panel member, and a substantially horizontal use position wherein the board member extends substantially orthogonally to the lower panel member. An iron retention housing is mounted behind the lower panel member and ironing board member so as to be accessible when the ironing board member is in its horizontal use position.

The exposed face of the lower panel member, and the corresponding face of the ironing board member, which is exposed when the latter is in its upright stored position and becomes the under surface of the ironing board, may, as in GB-A-2,328,449, be provided with a reflecting surface to act as a mirror.

The underside of the ironing board member is preferably connected to the lower panel member by a gas spring extensible strut, which is compressed to allow the ironing board member to be lowered into the use position. The strut raises the ironing board member into the upright stowed position once the board has been raised beyond a certain angle. The gas spring also counterbalances the weight of the board and controls its descent in a safer manner when being lowered. It provides a degree of resistance to lowering of the board, and thus prevents jarring of the board. The gas spring supports as if the board was undergoing an uncontrolled descent subject to gravity.

The iron retention housing most preferably has a floor which slopes backwards at an angle to accommodate a steam iron. This sloping floor encourages the iron to press its sole plate against a rear wall of the housing, to retain the iron in a safe position.

The ironing board may be provided with a cover which comprises a sandwich of card, a foamed synthetic plastics material, and a cotton fabric. The cotton fabric is preferably being metallised either by a coating containing metallic particles applied to the fabric after weaving of the fabric, or a similar coating applied to the yarns or fibres of the fabric before weaving the fabric. The cover is preferably attached to the ironing board member by an array of recessed press studs, which aids quick and easy replacement of worn, scorched or soiled covers. The cover advantageously does not wrap around the sides of the ironing board member, so that the exposed face of the board is available for other uses, for example as a mirror in accordance with the preferred feature of the invention above mentioned.

Preferably, apart from the gas spring strut, no structure is present below the board which could cause obstructions or constitute a hazard to children. Since the board is wall-mounted with no floor-resting structure, the device is safe and there is no risk of the board falling over, and the iron can be stowed safely in the iron retention housing even when still in use and switched on.

The installation may include a push button operated timer, with an indicator means such as an LED to indicate when the iron is switched on. The preset timer operates a switch to switch off the iron thereby reducing the risk of the iron being left unintentionally switched on, and reducing the risk of heat damage to textile work pieces and of fire.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
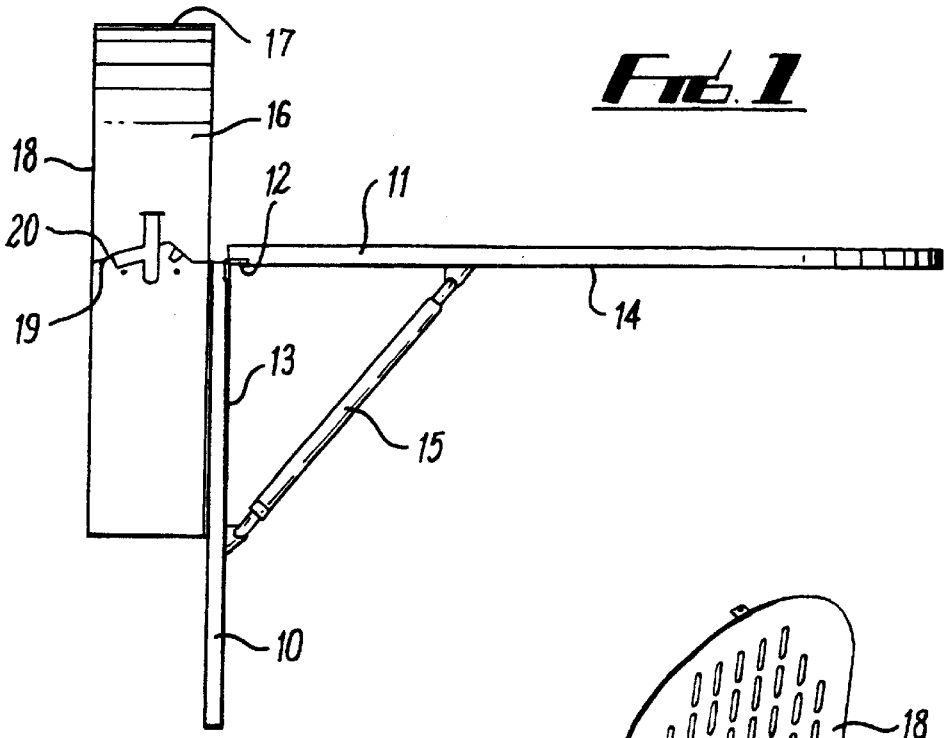
FIG. 1 is a side elevation of an ironing board installation according to the invention with the ironing board in its horizontal use position.
Figure 3:
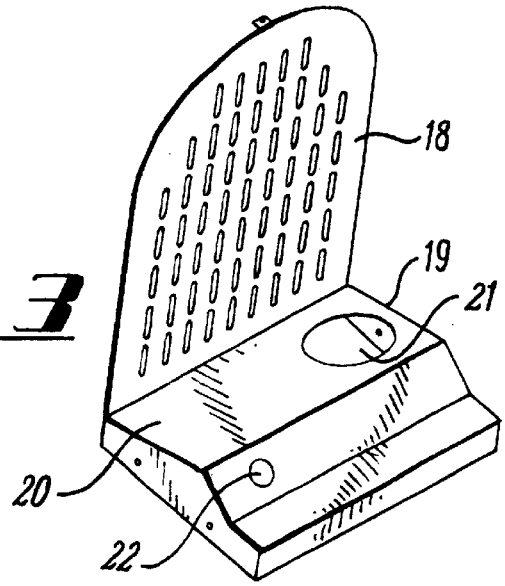
FIG. 3 is a perspective view of part of an iron retention housing forming part of the ironing board installation of FIGS. 1 and 2.
Figure 2:
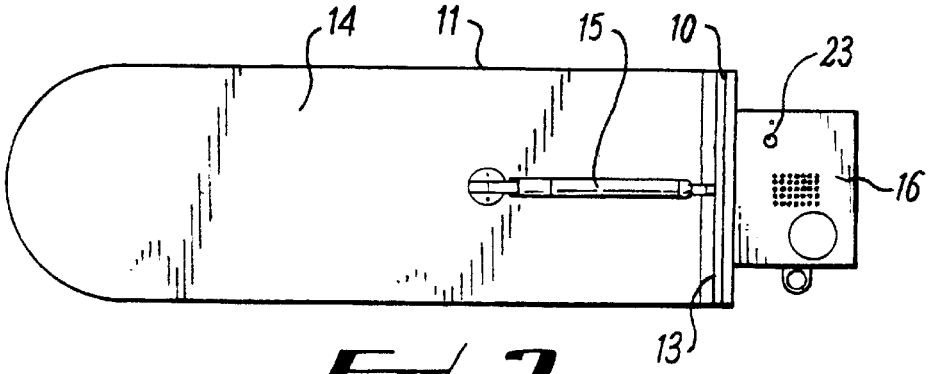
FIG. 2 is a view from above the ironing board installation of FIG. 1 with the ironing board in its horizontal use position.
Figure 4:
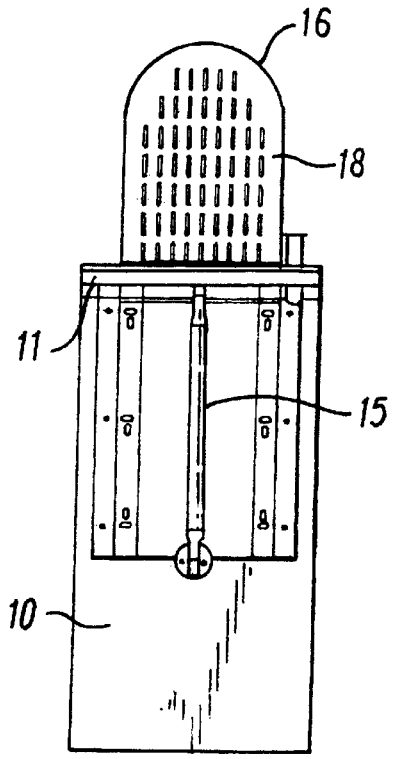
FIG. 4 is an elevation view from in front of the ironing board installation of FIG. 1, with the ironing board in its horizontal use position.

The ironing board installation according to the invention comprises a lower panel member 10, and an ironing board member 11 which are connected by a hinge 12 so that ironing board member 11 can be pivoted relative to panel member 10 between an upright stowed position (FIG. 5) and a substantially horizontal use position (FIG. 1). An exposed face 13 of panel member 10 and an underside 14 of ironing board member 11 (which is exposed when ironing board member 10 is in its upright stowed position) are provided with a reflective surface so that they can combine to act as a mirror, when the ironing board member is upright and are connected by an extensible and retractable gas cylinder strut 15.

Gas cylinder strut 15 extends to allow board 10 to be stowed upright, and is retracted to an integral rubber bump stop, allow the board to descend and to be supported firmly in its substantially horizontal use position. Gas cylinder strut 15 operates to assist raising of ironing board member 10 and will close it completely after the board has been raised beyond a certain angle, and on the other hand it provides a degree of resistance to lowering of the board so that falling open of the board under gravity, and possible jarring or impact is prevented.

An iron retention housing 16 is mounted behind panel 10 and board member 11. This may be surface mounted with its rear abutting a wall (not shown) or recessed into a wall, so that panel 10 and board 11 combinations is close to or flush with the wall.

Iron retention housing 16 comprises a cover 17 having an open front, and an embossed back plate 18 attached to a footplate 19. Foot plate 19 is formed with a slope 20, adapted to receive an iron, with the smoothing surface presented towards back plate 18, and the tapered front end pointing upwards so that the straight rear end of the iron rests on slope 20.

An aperture 21 in footplate 19 allows a flex or power supply cord to be connected to the iron from below. A timer circuit is mounted remotely inside the housing from a timer switch 22 and is provided to cut off the electricity supply to the iron after a predetermined time lapse during a long period of use. This prevents the iron remaining hot when unattended, this preventing heat damage to articles such as clothing if the iron is left due to, and reducing also the risk of fire.

An LED 23 mounted in the switch housing or else where is activated whilst the ironing is energised, providing a visual indication that it is likely to be hot, and is in use.

Figure 5:
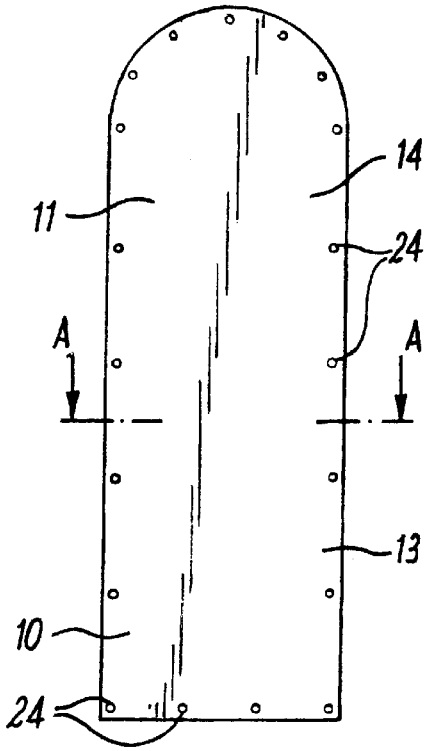
FIG. 5 is view of the underside of a cover for the ironing board.
Figure 6:
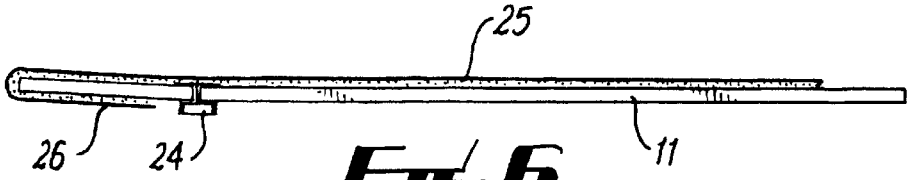
FIG. 6 shows a cross-section on line A—A through the ironing board cover of FIG. 5.
Figure 7:
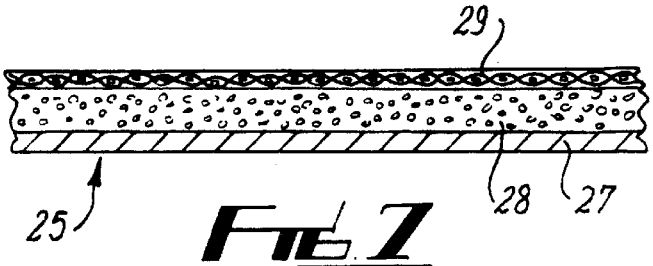
FIG. 7 shows an enlarged cross-sectional view of the material of the ironing board cover according to the invention.

As shown in FIG. 5, exposed upper (when horizontal) face 14 of panel 11 (ironing board) is provided with an array of press-studs 24 which can engage with complimentary press studs on a removable cover 25 (FIGS. 5 and 6). This covers only ironing surface 14 of ironing board 11, except for an end portion 26, which passes under the end of the board. As shown in FIG. 7, the cover is made from a composite comprising a backing layer 27 of card, covered with a heat insulating layer 28 of a foamed synthetic plastics material, for example polyurethane and a cotton fabric 29. This latter is coated, either by application to the fabric after weaving, or to the yarns or fibres before weaving, with a material including metal particles to provide a metallised finish to the fabric.

The cover is readily a fixable to the ironing board using the press studs, and equally easily removable to facilitate rapid replacement or refurbishment. The installation can be used a mirror when the ironing board is out of use.

Variations may be made to the construction of the ironing board installation of the invention, particularly in regard to features of shape and configuration. Covers of types other than that described may be used, whilst the safety timer or other cut off switches may be dispensed with, relying on the switches provided on the iron itself.

Accordingly, while at least one embodiment of the present invention has been shown and described, it is to be understood that many changes and modifications may be made thereunto without departing from the spirit and scope of the invention as defined in the appended claims.

What is claimed is:

1. A foldable ironing board installation for use with a pressing iron comprising:

an ironing board member capable of being in an upright stowed position or horizontal use position;

a lower panel member vertically disposed below said ironing board member and providing a continuous surface with said ironing board member when said ironing board member is in said upright stowed position;

a hinge coupling said ironing board member and said lower panel member, permitting said ironing board member to pivot between said upright stowed position and said horizontal use position; and a pressing iron retention housing mounted behind said lower panel member and said ironing board member so as to be accessible when said ironing board member is in its horizontal use position;

wherein said ironing board member extends perpendicularly from said lower panel member when said ironing board member is in said horizontal use position.

* * * * *